US012798637B2

(12) United States Patent
Ogawa

(10) Patent No.: US 12,798,637 B2
(45) Date of Patent: Nov. 17, 2026

(54) RAIL-GUIDED CARRIER SYSTEM

(71) Applicant: MURATA MACHINERY, LTD., Kyoto (JP)

(72) Inventor: Keisuke Ogawa, Ise (JP)

(73) Assignee: MURATA MACHINERY, LTD., Kyoto (JP)

( * ) Notice: Subject to any disclaimer, the term of this patent is extended or adjusted under 35 U.S.C. 154(b) by 388 days.

(21) Appl. No.: 18/287,479

(22) PCT Filed: Mar. 16, 2022

(86) PCT No.: PCT/JP2022/012017
§ 371 (c)(1),
(2) Date: Oct. 19, 2023

(87) PCT Pub. No.: WO2022/264579
PCT Pub. Date: Dec. 22, 2022

(65) Prior Publication Data
US 2024/0199097 A1 Jun. 20, 2024

(30) Foreign Application Priority Data
Jun. 16, 2021 (JP) ..... 2021-099980

(51) Int. Cl.
*B61L 23/04* (2006.01)
*B61B 3/02* (2006.01)

(52) U.S. Cl.
CPC ..... *B61L 23/041* (2013.01); *B61B 3/02* (2013.01)

(58) Field of Classification Search
CPC .... B61B 3/00; B61B 3/02; B61B 5/00; B61B 5/02; B61L 23/00; B61L 23/04; B61L 23/041
USPC ..... 104/89, 91, 93, 94, 95, 106
See application file for complete search history.

(56) References Cited

U.S. PATENT DOCUMENTS

2007/0169659 A1* 7/2007 Shimamura ..... E01B 25/22 104/94
2020/0286220 A1* 9/2020 Ogawa ..... B61L 23/041

FOREIGN PATENT DOCUMENTS

JP 10-124146 A 5/1998
JP 2019049447 A * 3/2019 ..... H10P 72/3214
JP 2020-143983 A 9/2020

OTHER PUBLICATIONS

Official Communication issued in International Patent Application No. PCT/JP2022/012017, mailed on Jun. 7, 2022.

* cited by examiner

*Primary Examiner* — S. Joseph Morano
*Assistant Examiner* — Heaven R Buffington
(74) *Attorney, Agent, or Firm* — Keating & Bennett, LLP

(57) ABSTRACT

A rail-guided vehicle system includes a detectable portion in front of a carrier at a predetermined position in a traveling direction and detectable by an obstacle detector, and a controller to determine a state of the obstacle detector based on a detection result of the detectable portion by the obstacle detector. The detectable portion is movable to advance into a travel space of the carrier at a time of inspection to check operation of the obstacle detector and to retreat from the travel space of the carrier at a time of passage when the carrier passes through an advance position of the detectable portion.

4 Claims, 11 Drawing Sheets

RAIL-GUIDED CARRIER SYSTEM

BACKGROUND OF THE INVENTION

1. Field of the Invention

An aspect of the present invention relates to a rail-guided vehicle system.

2. Description of the Related Art

A traveling vehicle configured to travel on a track to transport an article is known. The traveling vehicle is provided with an obstacle detection sensor configured to detect an obstacle that may be an obstruction when traveling on the track, and traveling of the traveling vehicle may be controlled based on whether the obstacle detection sensor detects the obstacle. However, in order to maintain proper traveling of the traveling vehicle, it is necessary to periodically check whether the obstacle detection sensor is operating properly. For example, Japanese Unexamined Patent Publication No. H10-124146 discloses an automatic operation check device configured to cause a traveling vehicle in automatic operation to move to a home position and automatically perform an inspection of an obstacle detection sensor at the home position.

SUMMARY OF THE INVENTION

The automatic operation check device in Japanese Unexamined Patent Publication No. H10-124146 is intended to inspect an obstacle detector provided to a carrier configured to travel on the ground, and is not intended to inspect an obstacle detector provided to a carrier configured to travel on a track.

Preferred embodiments of the present invention provide rail-guided vehicle systems each capable of automatically checking operation of an obstacle detector provided to a carrier to travel on a track.

A rail-guided vehicle system according to an aspect of a preferred embodiment of the present invention is a rail-guided vehicle system including a plurality of carriers each being movable along a track and including an obstacle detector to detect a carrier located forward in a traveling direction, a detectable portion in front of each carrier positioned at a predetermined position and detectable by the obstacle detector; and a controller to determine a state of the obstacle detector based on a detection result of the detectable portion by the obstacle detector, wherein the detectable portion is movable into a travel space of the carrier at a time of inspection to check operation of the obstacle detector and to retreat from the travel space of the carrier at a time of passage when the carrier passes through an advance position of the detectable portion, in the track, an internal space and a notch are provided, the internal space being separated from an external space and located along an extending direction of the track, the notch allowing the detectable portion to move between the internal space and the external space, the carrier includes a traveling unit to travel in the internal space, the obstacle detector is attached to the traveling unit, and the detectable portion is movable between the internal space and the external space and to advance into the internal space at the time of inspection and to retreat into the external space at the time of passage, and is provided with a lid to cover an area through which the detectable portion passes in the notch when the detectable portion has advanced into the internal space.

In this configuration, when the state of the obstacle detector of the carrier positioned at the predetermined position is checked (at the time of inspection), the detectable portion is caused to advance in front of the travel space of the carrier, and the state of the obstacle detector is determined based on the detection result of the detectable portion by the obstacle detector at this time. When the carrier passes through the advance position of the detectable portion (at the time of passage), the detectable portion is caused to retreat from the travel space of the carrier and thus does not hinder the carrier from traveling. By this configuration, the operation of the obstacle detector provided to the carrier configured to travel on the track can be checked automatically.

In a rail-guided vehicle system according to an aspect of a preferred embodiment of the present invention, the obstacle detector may include a light receiver and the detectable portion may include a light emitter attached to a plate. In this configuration, operation of the light receiver provided to the carrier can be checked automatically.

In a rail-guided vehicle system according to an aspect of a preferred embodiment of the present invention, the track may include an internal space separated from an external space and located along an extending direction of the track, the carrier may include a traveling unit configured to travel in the internal space, the obstacle detector may be attached to the traveling unit, the light emitter may be movable between the internal space and the external space, and may be movable to advance into the internal space at the time of inspection and to retreat into the external space at the time of passage. In this configuration, operation of the light emitter attached to the traveling unit to travel in the internal space of the track can be checked automatically.

In a rail-guided vehicle system according to an aspect of a preferred embodiment of the present invention, a notch to allow the light emitter and the plate to move between the internal space and the external space may be provided in the track, and a lid to cover an area through which the light emitter passes in the notch, when the light emitter has advanced into the internal space may be provided on the plate. In this configuration, the notch is covered by the lid when the light emitter has advanced into the internal space, whereby disturbance light, for example, can be prevented from entering the internal space from the external space. By this configuration, the operation of the light emitter can be checked more reliably without being affected by disturbance light.

In a rail-guided vehicle system according to an aspect of the present invention, the carrier may include a rear light emitter to cause a carrier located behind on the track to detect a presence of the carrier. The rail-guided vehicle system may further include a light-emitter detector provided behind the carrier positioned at the predetermined position to detect light emitted from the rear light emitter. The light-emitter detector may be movable to advance into the travel space of the carrier at a time of inspection to check operation of the rear light emitter and to retreat from the travel space of the carrier at a time of passage when the carrier passes through an advance position of the light-emitter detector. The controller may determine a state of the rear light emitter based on a detection result by the light-emitter detector. When the state of the rear light emitter of the carrier positioned at the predetermined position is checked (at the time of inspection), the light-emitter detector is caused to emerge behind the carrier, and the state of the rear light emitter is determined based on the detection result by the light-emitter detector at this time. By this configuration, the operation of the rear light emitter provided to the carrier configured to travel on the track can be checked automatically.

In a rail-guided vehicle system according to an aspect of a preferred embodiment of the present invention, the obstacle detector may include a light receiver and a light emitter, and the detectable portion may be a reflector capable of reflecting light emitted from the light emitter. In this configuration, operation of the light emitter and the light receiver provided to the carrier can be checked automatically.

In a rail-guided vehicle system according to an aspect of a preferred embodiment of the present invention, the reflector may be movably attached to a frame-shaped body surrounding the travel space of the carrier so as to allow the carrier to pass therethrough in the traveling direction. The reflector may be movably provided so as to advance into the travel space of the carrier at the time of inspection and to retreat from the travel space of the carrier at the time of passage. In this configuration, the reflector can be caused to retreat from the travel space of the carrier so as not to hinder the carrier from traveling when the carrier passes therethrough.

According to an aspect of a preferred embodiment of the present invention, the operation of the obstacle detector provided to the carrier to travel on the track can be checked automatically.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments according to aspects of the present invention will now be described in detail with reference to the drawings. In description of the drawings, like elements are designated by like reference signs, and duplicate description is omitted.

Figure 1:
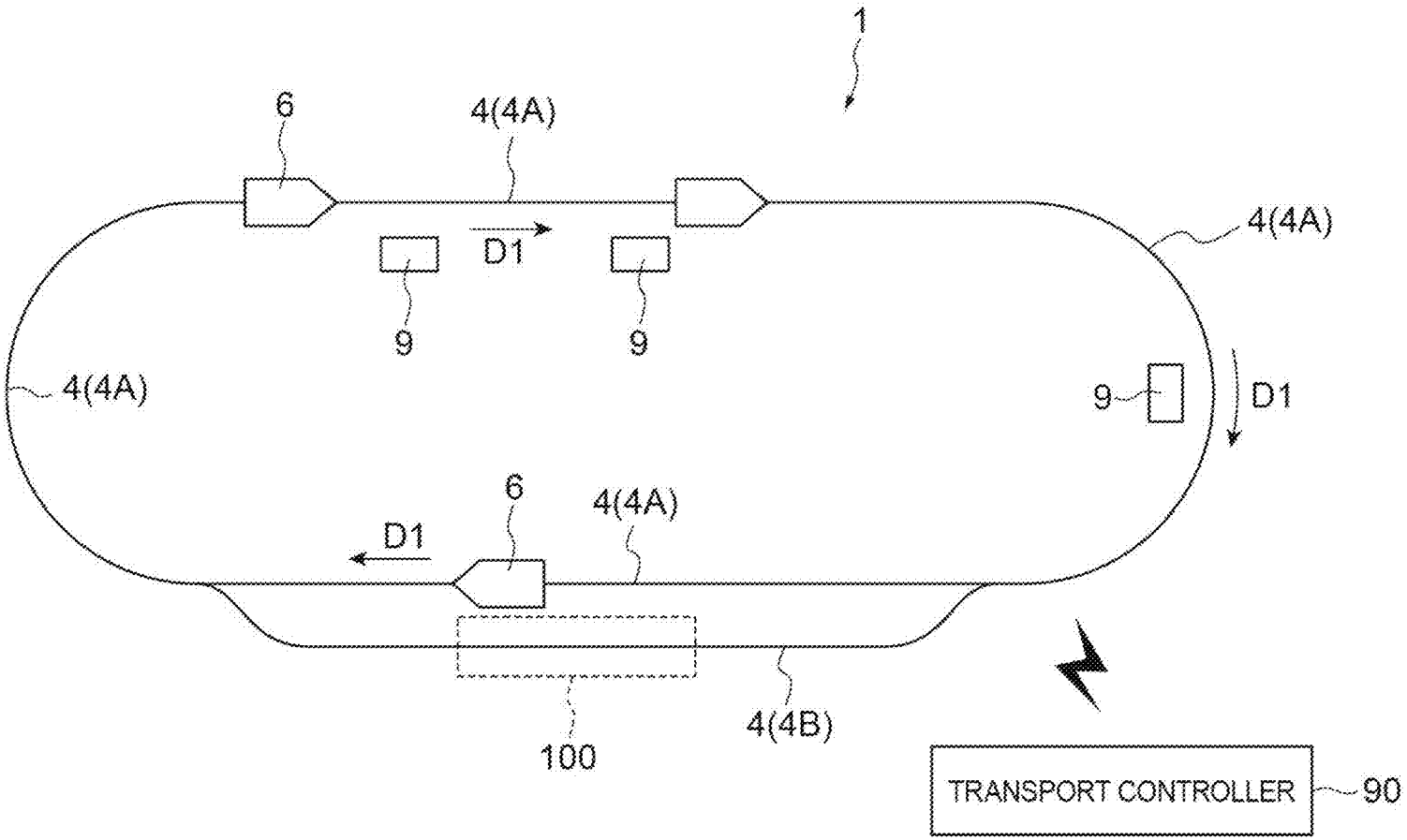
FIG. 1 is a schematic plan view illustrating a configuration of a rail-guided vehicle system according to a preferred embodiment of the present invention.
Figure 2:
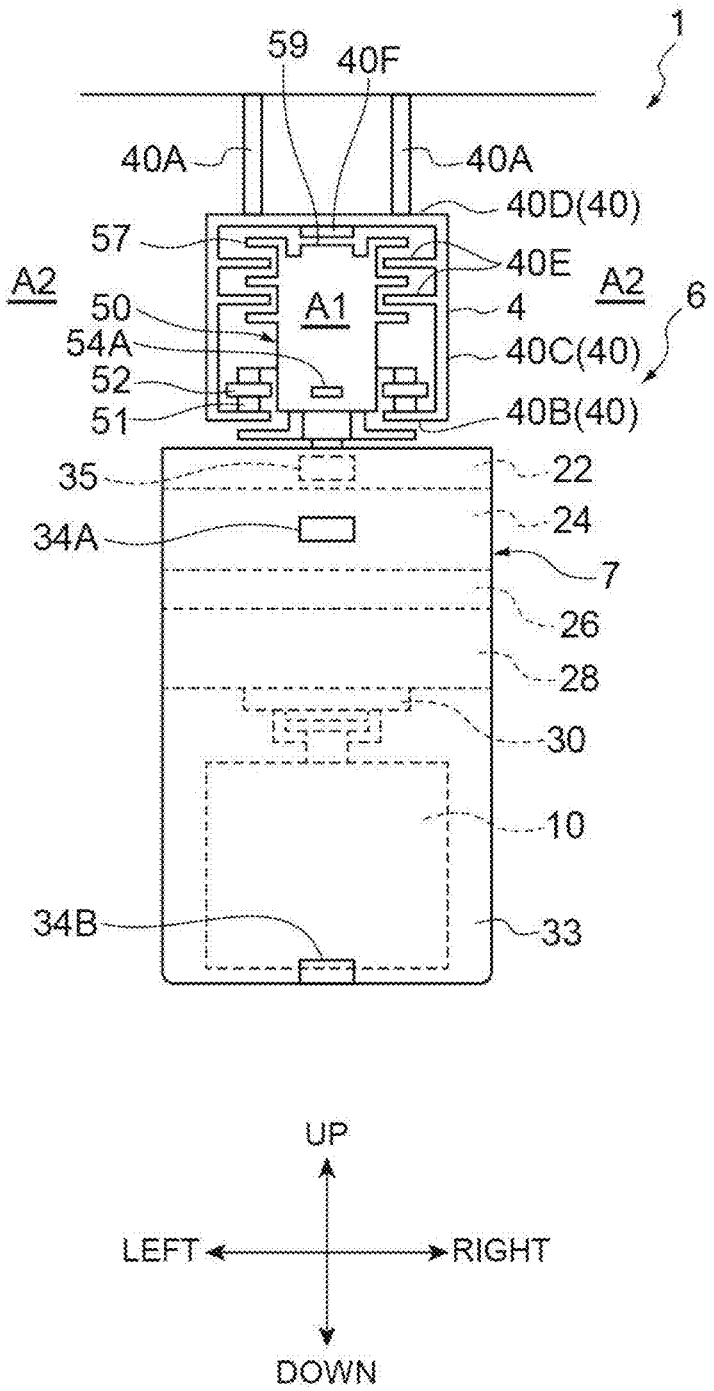
FIG. 2 is a front view illustrating a traveling vehicle when viewed from front in a traveling direction.

As illustrated in FIGS. 1 and 2, a rail-guided vehicle system 1 is a system using an overhead traveling vehicle (carrier) 6 (hereinafter, referred to as "traveling vehicle 6") movable along a track 4 to transport an article 10. Examples of the article 10 include containers such as a front opening unified pod (FOUP) storing a plurality of semiconductor wafers, a reticle pod storing a glass substrate, general components, and the like. The rail-guided vehicle system 1 includes the track 4, a plurality of the traveling vehicles 6, a plurality of loading portions 9, an inspection unit 100, and a transport controller 90.

The track 4 is installed near a ceiling, which is an overhead space of a worker, for example. The track 4 is suspended from the ceiling, for example. The track 4 is a predetermined traveling path on which the traveling vehicles 6 travel. The track 4 is supported by posts 40A, 40A. The track 4 of the rail-guided vehicle system 1 includes a main-track section 4A, where the traveling vehicles 6 travel around a predetermined area in one direction D1, and a siding-track section 4B, where each traveling vehicle 6 is introduced into the inspection unit 100 for inspection of the traveling vehicle 6. Even in the siding-track section 4B, the traveling vehicle 6 travels in the predetermined one direction D1.

The track 4 includes a rail body 40 having a tubular shape, a portion of which is open and including a pair of bottom portions 40B, 40B, a pair of side portions 40C, 40C, and a top portion 40D, power supply units 40E, and a magnetic plate 40F. The rail body 40 defines an internal space A1 separated from an external space A2. The internal space A1 extends along an extending direction of the track 4. The rail body 40 houses a traveling unit 50 of each traveling vehicle 6 described later in detail. The bottom portions 40B extend in the traveling direction D1 of the traveling vehicle 6 and define the bottom of the rail body 40. The bottom portions 40B are plates on which traveling rollers 51 of the traveling vehicle 6 roll and the traveling vehicle 6 travels. The side portions 40C extend in the traveling direction D1 of the traveling vehicle 6 and define the sides of the rail body 40. The top portion 40D extends in the traveling direction D1 of the traveling vehicle 6 and defines the top of the rail body 40.

The power supply units 40E are components configured to supply power to power-supplying cores 57 of the traveling vehicle 6 and transmit and receive signals to and from the power-supplying cores 57. The power supply units 40E are each fixed to the pair of side portions 40C, 40C and extend along the traveling direction D1. The power supply units 40E provide power to the power-supplying cores 57 in a non-contact manner. The magnetic plate 40F causes a linear DC motor (LDM) 59 of the traveling vehicle 6 to generate magnetic force for traveling or stopping. The magnetic plate 40F is fixed to the top portion 40D and extends along the traveling direction D1.

The traveling vehicle 6 travels along the track 4 and transports the article 10. The traveling vehicle 6 is configured to be able to transfer the article 10. The traveling vehicle 6 is an overhead traveling unmanned vehicle. The number of the traveling vehicles 6 included in the rail-guided vehicle system 1 is not limited to a particular one, and is two or more. The traveling vehicle 6 includes a main unit 7, the traveling unit 50, and a main-unit controller 35. The main unit 7 includes a main frame 22, a lateral feed unit 24, a C drive 26, a lifting drive unit 28, a lifting platform 30, a cover 33, an anti-collision sensor (obstacle detector) 34A, and an obstacle sensor (obstacle detector) 34B.

The main frame 22 is connected to the traveling unit 50 and supports the lateral feed unit 24, the C drive 26, the lifting drive unit 28, the lifting platform 30, and the cover 33. The lateral feed unit 24 laterally feeds the C drive 26, the lifting drive unit 28, and the lifting platform 30 all together in a direction perpendicular to the extending direction of the track 4. The C drive 26 rotates at least one of the lifting drive unit 28 and the lifting platform 30 within a predetermined angular range in a horizontal plane. The lifting drive unit 28 raises and lowers the lifting platform 30 by winding and paying out suspending members such as wires, ropes, and belts. The lifting platform 30 is provided with a chuck to allow the article 10 to be grasped or released. The cover 33 is provided, for example, in a pair on the front and the rear of the traveling vehicle 6 in the traveling direction D1. The covers 33 allow claws and other elements or portions, which are not illustrated, to advance or retreat, thereby preventing the article 10 from falling during transport.

The anti-collision sensor 34A is provided on an upper portion of the front cover 33 of the pair of covers 33, 33. The anti-collision sensor 34A emits light forward in the traveling direction D1 and detects the presence or absence of another traveling vehicle 6 located forward in the traveling direction D1 on the basis of whether its reflected light has been detected. In other words, the anti-collision sensor 34A includes a light-emitting portion and a light-receiving portion. The obstacle sensor 34B is provided on a lower portion of the front cover 33 of the pair of covers 33, 33. The obstacle sensor 34B emits light forward in the traveling direction D1 and detects the presence or absence of an obstacle located forward in the traveling direction D1 on the basis of whether its reflected light has been detected. In other words, the obstacle sensor 34B includes a light-emitting portion and a light-receiving portion. Detection results by the anti-collision sensor 34A and the obstacle sensor 34B are acquired by the main-unit controller 35.

The traveling unit 50 travels in the internal space A1 provided in the track 4 as described above. The traveling unit 50 mainly includes the traveling rollers 51, side rollers 52, the light receiver (obstacle detector) 54A, the light emitter (rear light emitter) 54B (see FIGS. 3 and 4), the power-supplying cores 57, and the LDM 59. The traveling rollers 51 are a pair of rollers including outer wheels as traveling wheels and inner wheels as traveling auxiliary wheels. The traveling rollers 51 are disposed at both of the right and the left ends on the front and the rear of the traveling unit 50. The traveling rollers 51 roll on the pair of bottom portions 40B, 40B of the track 4.

The side rollers 52 are disposed so as to sandwich each of the traveling rollers 51 in the front-and-rear direction. The side rollers 52 are capable of being in contact with the side portions 40C of the track 4. The power-supplying cores 57 are disposed on the front and the rear of the traveling unit 50 so as to sandwich the LDM 59 in the right-and-left direction. The power supply units 40E disposed in the track 4 supply power to the power-supplying cores 57 in a non-contact manner, and transmit and receive various signals therebetween in a non-contact manner. The power-supplying cores 57 also exchange signals with the main-unit controller 35. The LDM 59 is provided at each of the front and the rear of the traveling unit 50. The LDM 59 generates, by an electromagnet, magnetic force for traveling or stopping with the magnetic plate 40F disposed on the top of the track 4.

The light receiver 54A is provided on the front of the traveling unit 50. The light receiver 54A receives light emitted from a light emitter 54B provided on a forward traveling vehicle 6 that is located within a predetermined range of distance from the traveling vehicle 6. In other words, the light receiver 54A cannot receive light emitted from a light emitter 54B provided on a forward traveling vehicle 6 that is located outside the predetermined range of distance from the traveling vehicle 6. The detection result by the light receiver 54A is acquired by the main-unit controller 35. When light has been received by the light receiver 54A, the main-unit controller 35 determines that the traveling vehicle 6 is located forward within the predetermined range of distance from the traveling vehicle 6.

The light emitter 54B is provided on the rear of the traveling unit 50. The light emitter 54B emits light rearward from the traveling vehicle 6. The light-emission distance of the light emitter 54B is set so that light can be received by a light receiver 54A provided on a rearward traveling vehicle 6 that is located within a predetermined distance from the traveling vehicle 6. The light emission by the light emitter 54B is controlled by the main-unit controller 35.

The traveling unit 50 is controlled by the transport controller (controller) 90, which is described later in detail, via the main-unit controller 35. Specifically, instructions from the transport controller 90 are transmitted to the main-unit controller 35, and the main-unit controller 35 that has received the instructions controls the traveling unit 50.

The loading portions 9 are disposed along the track 4, and are provided at positions where each traveling vehicle 6 can deliver or receive an article 10. Each loading portion 9 includes a buffer and a delivery port. The buffer is a loading portion on which an article 10 is temporarily placed. For example, the buffer is a loading portion on which an article 10 being transported by the traveling vehicle 6 is temporarily put when the article 10 cannot be transferred onto a delivery port as a destination for the reason that, for example, another article 10 has been placed on the delivery port. The delivery port is a loading portion to deliver and receive an article 10 to and from a semiconductor processing device (not illustrated) including cleaning equipment, deposition equipment, lithography equipment, etching equipment, thermal processing equipment, and planarization equipment. Herein, the processing device is not limited to a particular one, and may be a device of various types.

The loading portion 9 is disposed beside the track 4. In this case, each traveling vehicle 6 laterally feeds the lifting drive unit 28, for example, with the lateral feed unit 24 and slightly raises and lowers the lifting platform 30, thereby delivering and receiving an article 10 to and from the loading portion 9. Although not illustrated, the loading portion 9 may be disposed directly below the track 4. In this case, the traveling vehicle 6 raises and lowers the lifting platform 30, thereby delivering and receiving the article 10 to and from the loading portion 9.

The main-unit controller 35 is an electronic control unit including a central processing unit (CPU), a read only memory (ROM), a random access memory (RAM). The main-unit controller 35 controls various operations of the traveling vehicle 6. Specifically, the main-unit controller 35 controls the traveling unit 50, the lateral feed unit 24, the θ drive 26, the lifting drive unit 28, and the lifting platform 30.

The main-unit controller 35 can be configured, for example, as software such that a program stored in the ROM is loaded into the RAM to be executed by the CPU. The main-unit controller 35 may be configured as hardware such as an electronic circuit. The main-unit controller 35 communicates with the transport controller 90 using the power supply units 40E and the like of the track 4.

Figure 3:
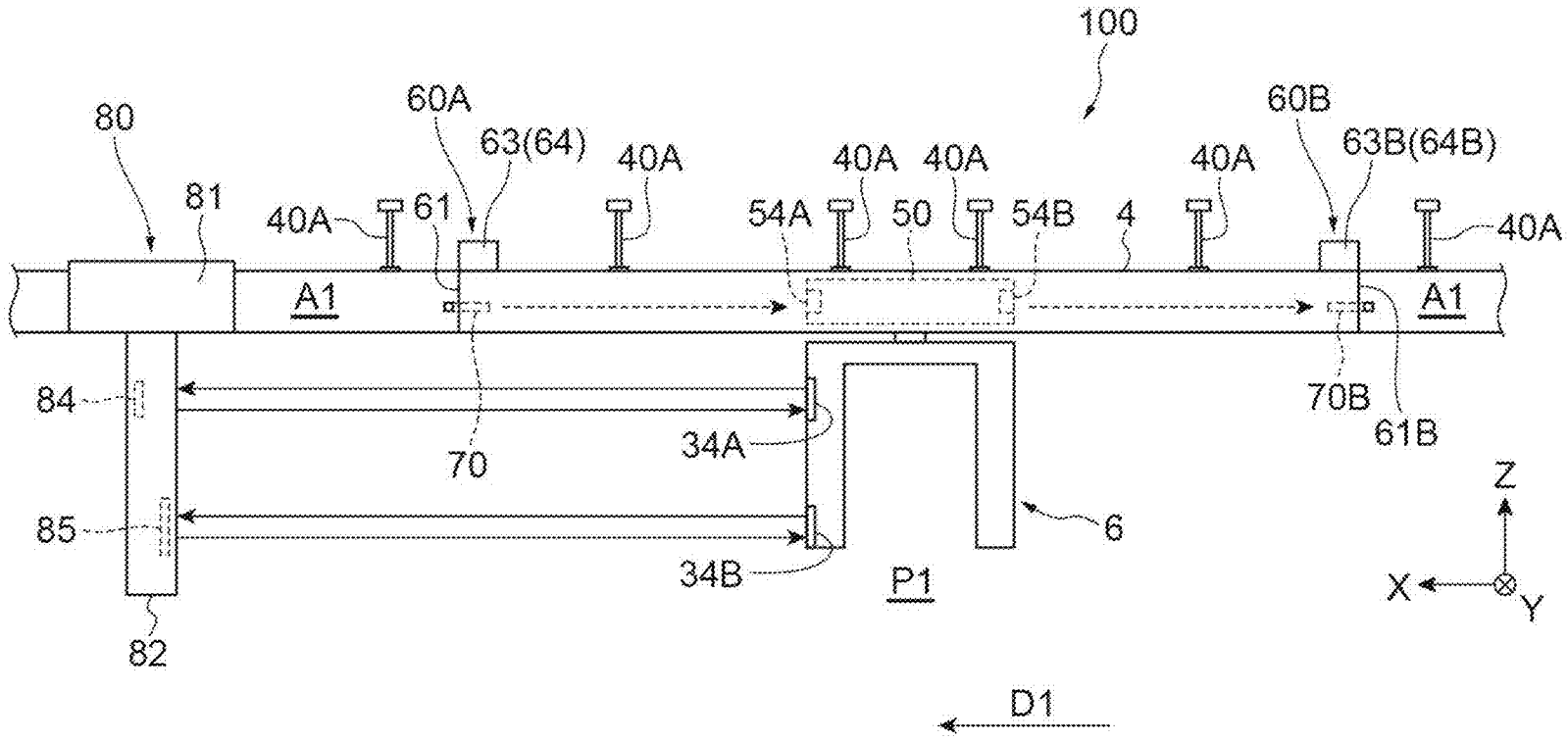
FIG. 3 is a side view of an inspection unit when viewed from side.
Figure 4:
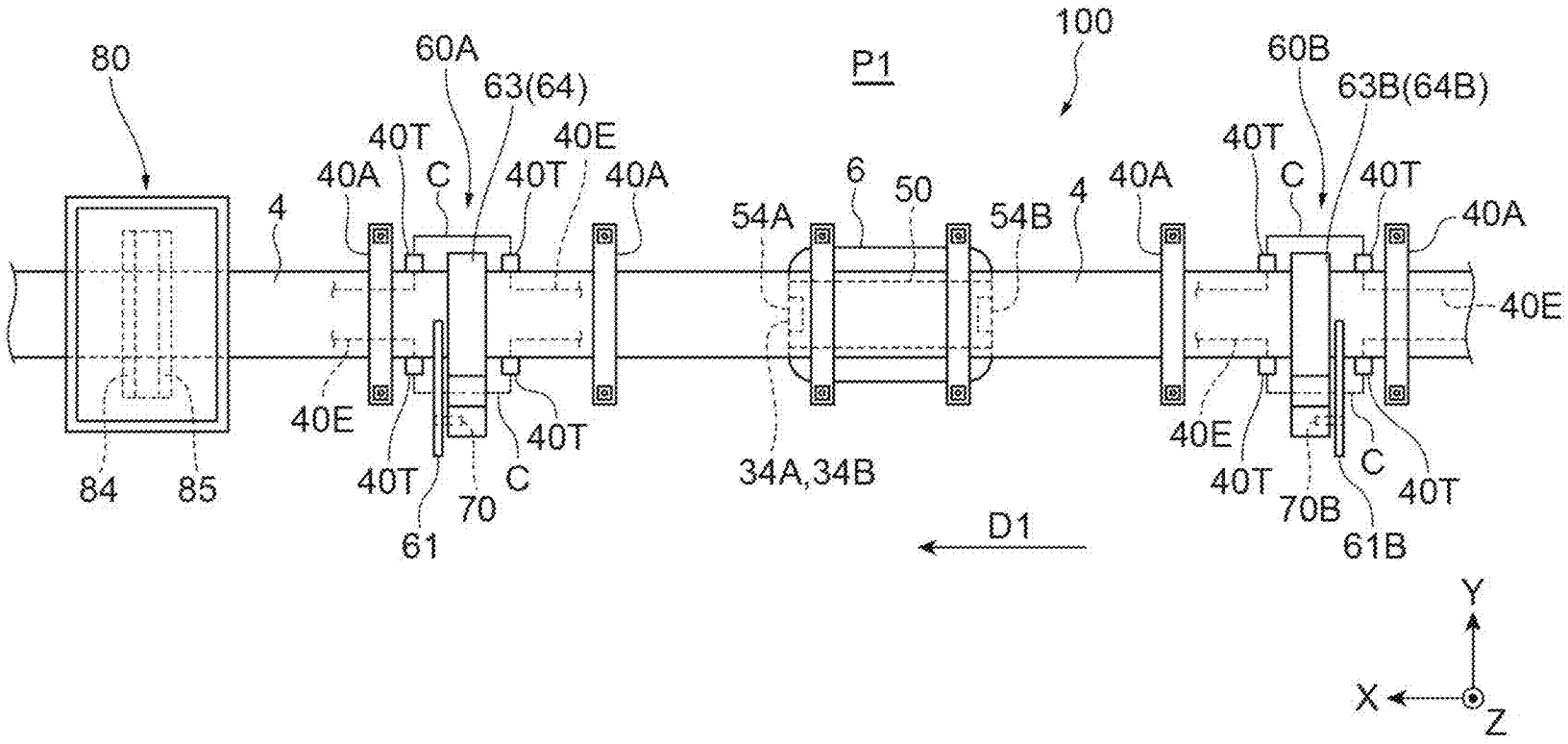
FIG. 4 is a top view of the inspection unit when viewed from above.

The inspection unit 100 is a group of devices provided to a portion of the siding-track section 4B as illustrated in FIG. 1 and configured to check operations of the light receiver 54A, the light emitter 54B, the anti-collision sensor 34A, and the obstacle sensor 34B mounted on the traveling vehicle 6 as illustrated in FIGS. 3 and 4. The inspection unit 100 includes a first inspection device 60A, a second inspection device 60B, and a third inspection device 80. The first inspection device 60A and the second inspection device 60B are disposed, in the extending direction of the track 4, so as to sandwich an inspection position (predetermined position) P1 that is a position where the traveling vehicle 6 stops when being inspected in the inspection unit 100.

Figure 7A:
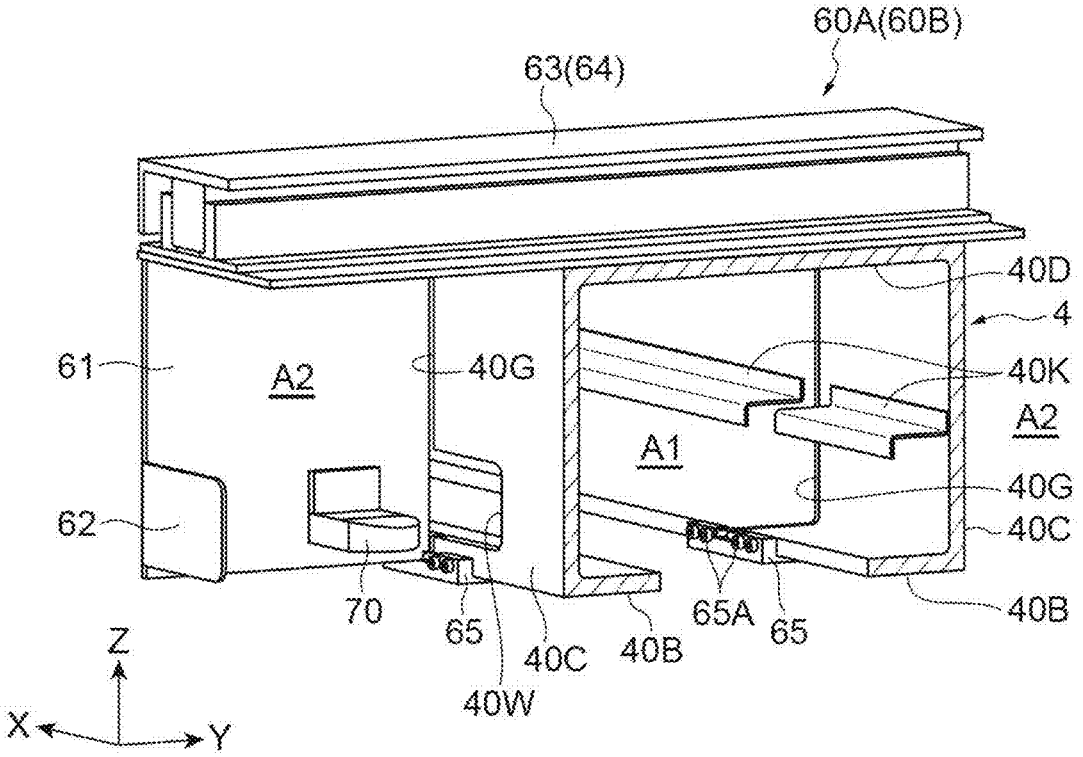
FIG. 7A is a perspective view of a plate and a light emitter when they are in a retreat state.
Figure 7B:
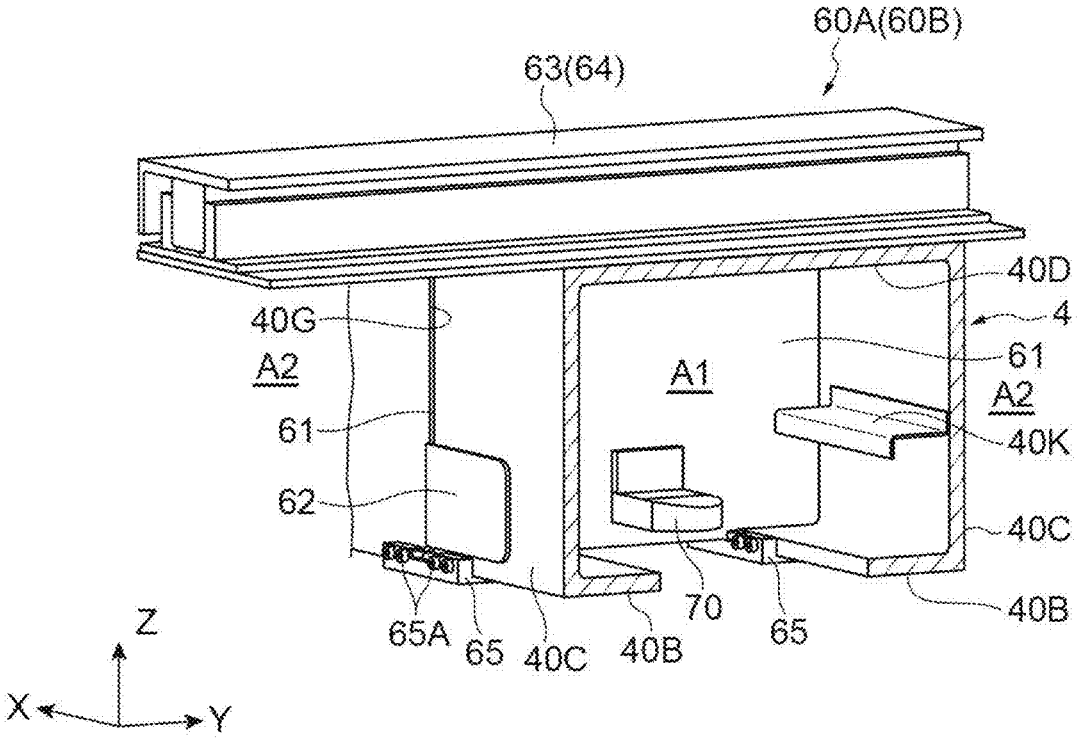
FIG. 7B is a perspective view of the plate and the light emitter when they are in an advance state.

The first inspection device 60A is disposed at a position forward in the traveling direction D1 when viewed from the traveling vehicle 6 stopping at the inspection position P1. The distance between the inspection position P1 and the first inspection device 60A is about two meters, for example. The first inspection device 60A is a device configured to check the operation of the light receiver 54A mounted on the traveling vehicle 6 stopping at the inspection position P1. A light emitter (detectable portion) 70 of the first inspection device 60A is movable to advance into a travel space of the traveling vehicle 6 at a time of inspection to check the operation of the light receiver 54A and to retreat from the travel space of the traveling vehicle 6 at a time of passage when the traveling vehicle 6 passes through an advance position of the light emitter 70 (during normal operation without checking the operation of the light receiver 54A). More specifically, the light emitter 70 is movable between the internal space A1 and the external space A2, and is driven by a first drive unit 64 (see FIG. 5) so as to advance into the internal space A1 at the time of inspection as illustrated in FIG. 7B and to retreat into the external space A2 at the time of passage (during normal operation) as illustrated in FIG. 7A.

Figure 5:
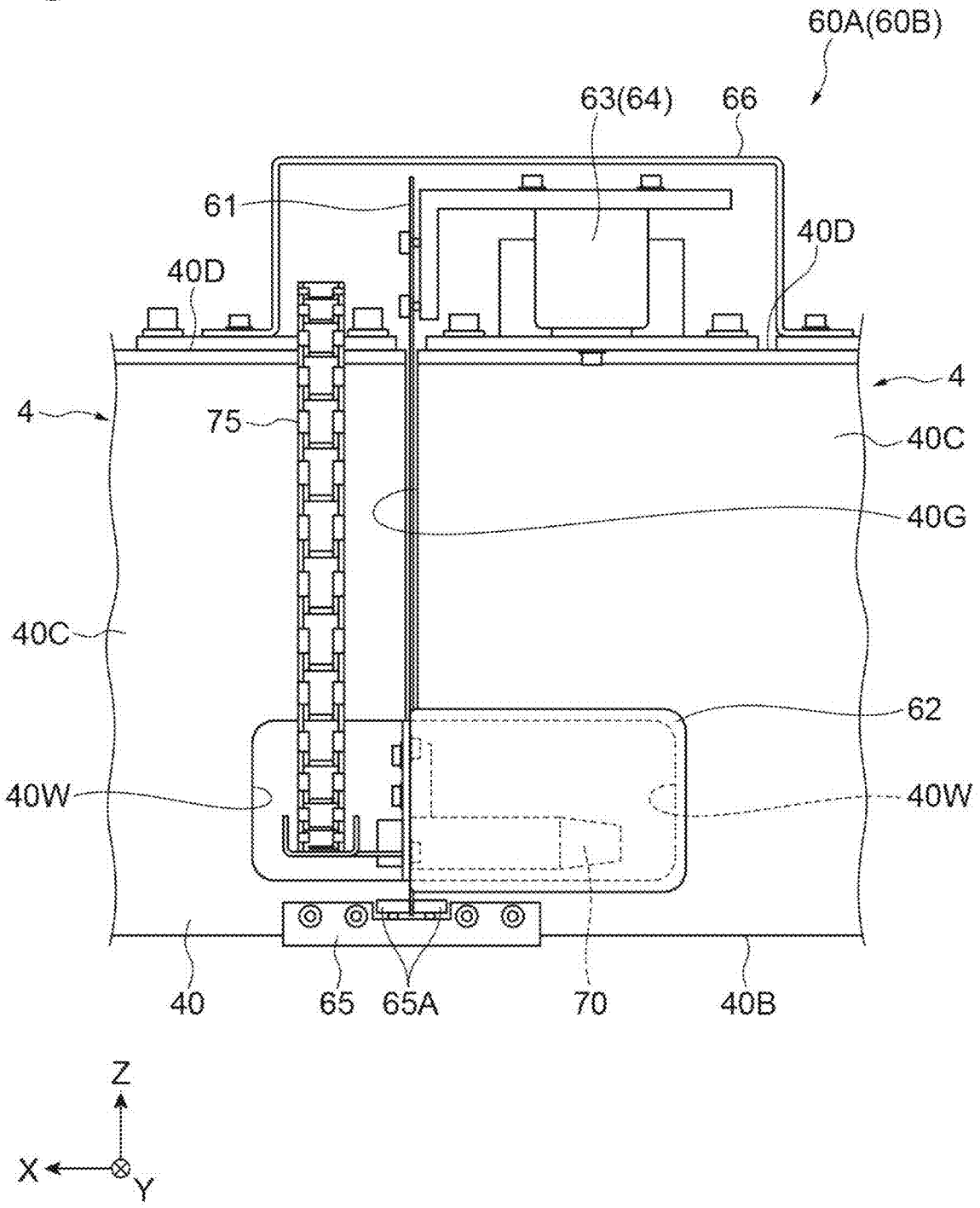
FIG. 5 is a side view of a first inspection device when viewed from side.
Figure 6:
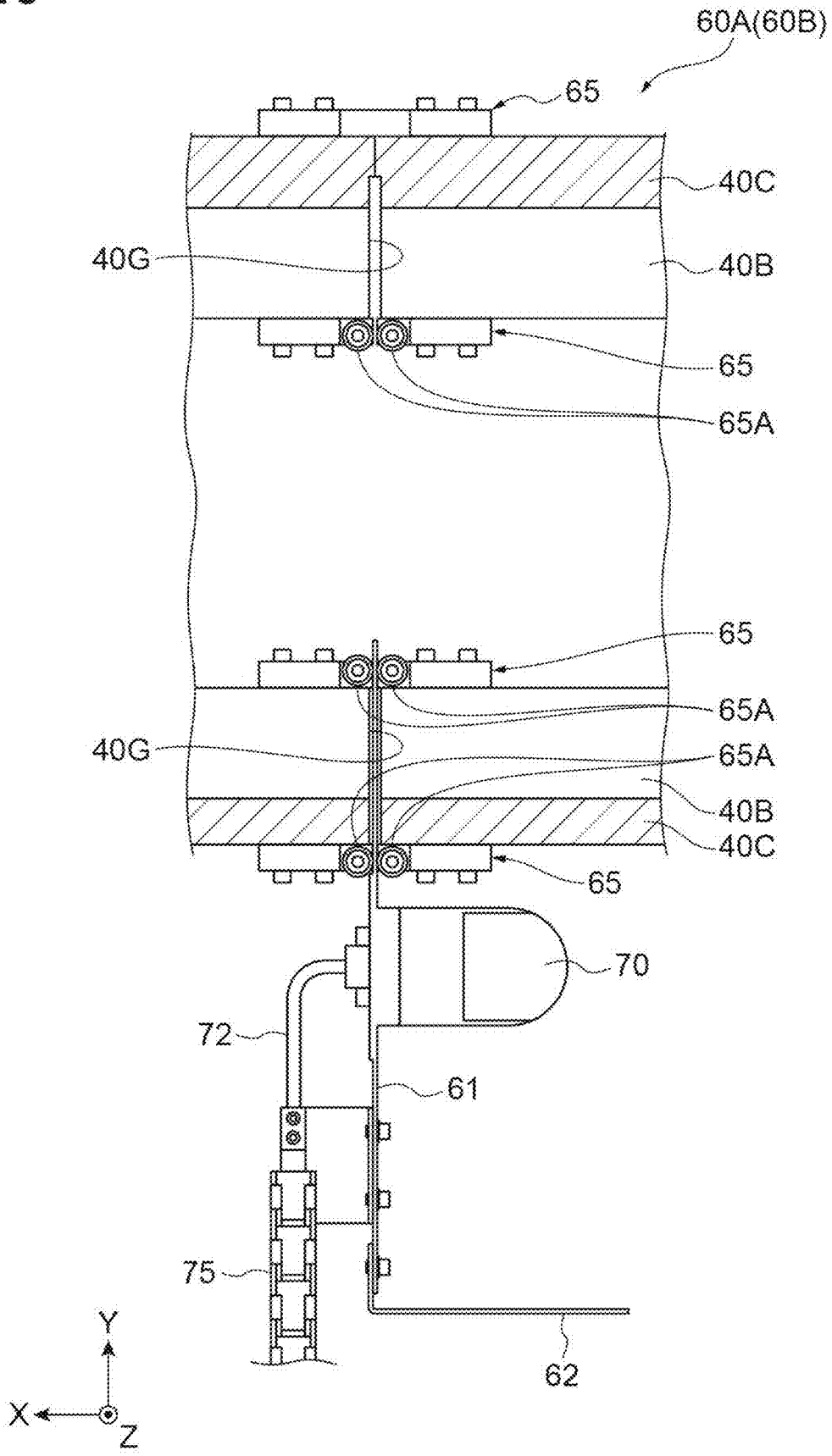
FIG. 6 is a top view of a portion of the first inspection device when viewed from above.

As illustrated in FIGS. 5 and 6, the first inspection device 60A includes a plate 61, a slide mechanism 63, the first drive unit 64, a lower connecting member 65, an upper connecting member 66, and the light emitter 70. The following describes the respective components of the first inspection device 60A in detail. The plate 61 is capable of passing through a gap 40G in the track 4 in the X-direction. The size of the gap 40G is, for example, five millimeters, and the plate 61 is formed to have a thickness that can be inserted into the gap 40G. The gap 40G may be formed, for example, by connecting the tracks 4, 4 with a clearance formed therebetween in the X-direction. The tracks 4, 4 are connected, for example, by the lower connecting member 65 and the upper connecting member 66.

The plate 61 is connected to the slide mechanism 63 disposed on the top portion 40D of the track 4. The slide mechanism 63 is, for example, a linear guide configured to support the plate 61 including a main surface in the X-direction in a manner movable in the Y-direction. When the plate 61 moves in the Y-direction, it is guided (clamped) by a pair of guide rollers 65A, 65A provided on the lower connecting member 65. The guide rollers 65A, 65A are made of resin, for example. The lower connecting member 65 including these guide rollers 65A, 65A is provided at three locations along the Y-direction, and thus the plate 61 configured to be moved in the Y-direction by the slide mechanism 63 can move smoothly through the gap 40G in the track 4. Furthermore, another lower connecting member 65 that does not include guide rollers 65A, 65A and includes only the function of connecting the tracks 4 is provided. The slide mechanism 63 is driven by the first drive unit 64. The first drive unit 64 is capable of communicating with the transport controller 90 (see FIG. 11) and is controlled by the transport controller 90.

The light emitter 70 is attached to the plate 61 as described above and is thus movable between the internal space A1 and the external space A2. The light emitter 70 is attached so as to protrude toward the inspection position P1. The light emitter 70 is connected to a control box (not illustrated) disposed on the top portion 40D or the like of the track 4 via a cable 72 housed in a cable guide 75. The control box is capable of communicating with the transport controller 90. The light emitter 70, to which power necessary for operation is supplied via the cable 72, communicates with the transport controller 90 via the cable 72.

As illustrated in FIG. 7A, in a side portion 40C of track 4, a notch 40W configured to allow the light emitter 70 attached to the plate 61 to move between the internal space A1 and the external space A2 is provided. As illustrated in FIG. 7B, the plate 61 is provided with a lid 62 configured to cover an area through which the light emitter 70 passes in the notch 40W, when the light emitter 70 has advanced into the internal space A1. In other words, when the light emitter 70 has advanced into the internal space A1, the lid 62 shields the space defined by the notch 40W and connecting the internal space A1 with the external space A2. By this configuration, disturbance light can be prevented from entering the space between the traveling vehicle 6 and the plate 61 (i.e., the space between the light emitter 70 and the light receiver 54A through which light emitted from the light emitter 70 passes) from the external space.

Figure 8A:
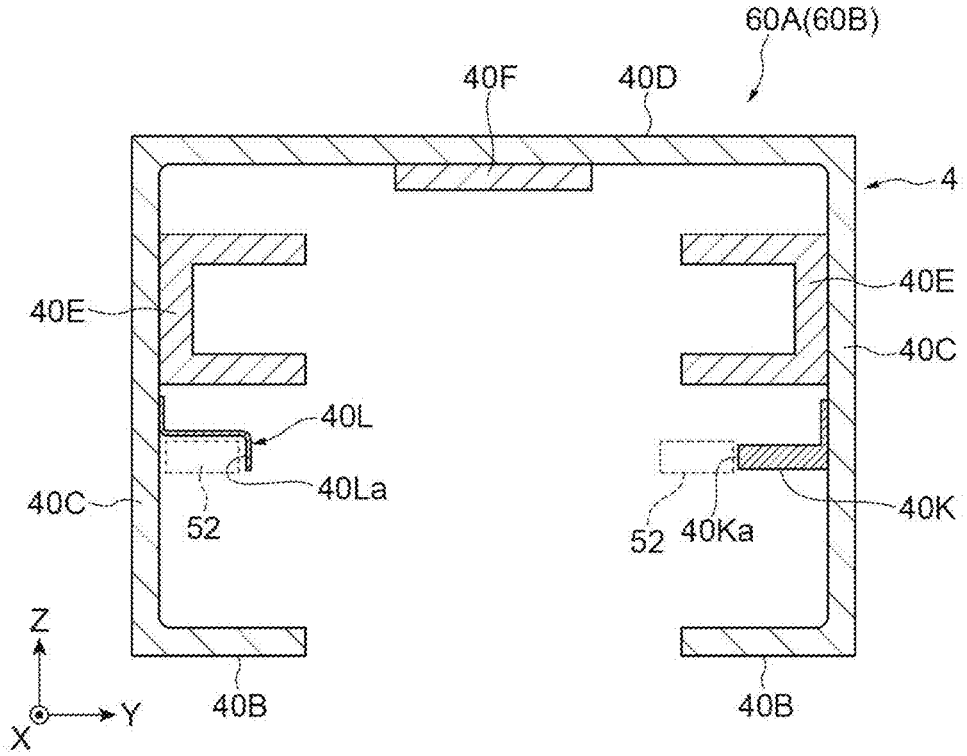
FIG. 8A is a sectional view of a track at a position where the first inspection device is disposed, when viewed from front in the traveling direction.
Figure 8B:
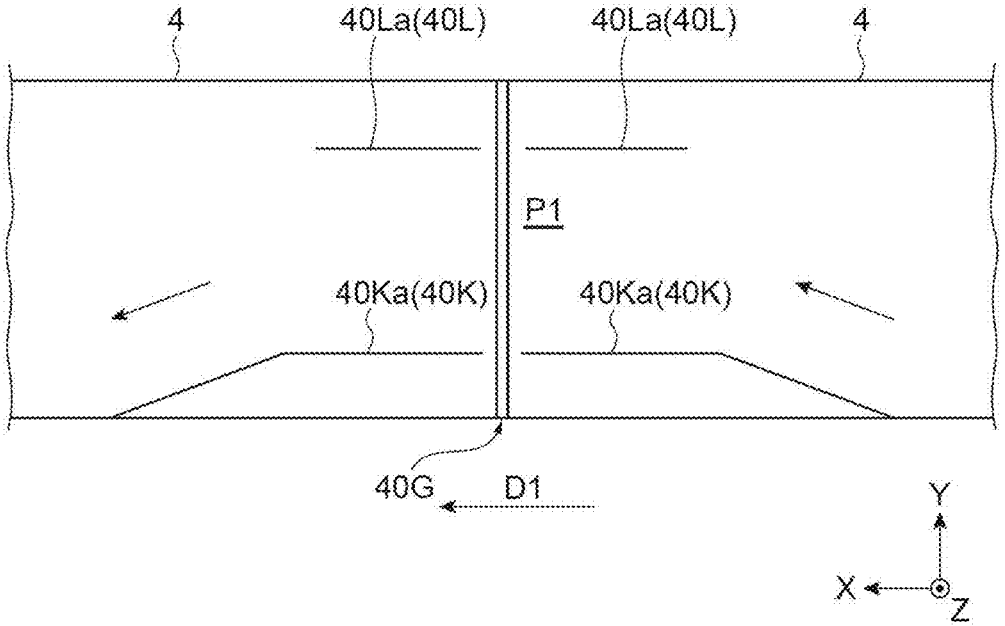
FIG. 8B is a diagram illustrating arrangement of a first leading guide and a second leading guide disposed on the track near the position where the first inspection device is disposed.

As illustrated in FIG. 8A, on the side portions 40C (inner surfaces) of each track 4, a first leading guide 40K and a second leading guide 40L are provided. On the first leading guide 40K, a side surface 40Ka with which the side rollers 52 come into contact is provided. The first leading guide 40K is provided on the side portion 40C on the left toward the traveling direction D1. As illustrated in FIG. 8B, the side surfaces 40Ka include a portion configured to guide the side rollers 52 (i.e., the traveling vehicle 6) to the right in the traveling direction D1 toward the gap 40G and a portion configured to guide the side rollers 52 to the left in the traveling direction D1 away from the gap 40G.

As illustrated in FIG. 8A, on the second leading guide 40L, a side surface 40La configured to come into contact with the side rollers 52 is provided. The second leading guide 40L is provided on the side portion 40C on the right toward the traveling direction D1 (X-direction). As illustrated in FIG. 8B, the second leading guides 40L extend from the position where the side rollers 52 have finished being guided to the right in the traveling direction D1 by the side surface 40Ka to the position where the side rollers 52 starts being guided to the left in the traveling direction D1 by the side surface 40Ka.

The traveling unit 50 configured to travel on the track 4 including the first leading guide 40K and the second leading guide 40L thus configured is guided to the right in the internal space A1 at the inspection position P1. This prevents the side rollers 52 from running off from the notch 40W of the side portion 40C on the left toward the traveling direction D1. The first leading guide 40K and the second leading guide 40L guide (position) the traveling unit 50 so that light emitted from the light emitter 70 can be received by the light receiver 54A, and also guide (position) the traveling unit 50 so that light emitted from the light emitter 54B can be received by a light receiver 70B (light-emitter detector) described later in detail.

In the first inspection device 60A, the first leading guide 40K and the second leading guide 40L are divided across the gap 40G so as not to hinder the movement of the plate 61 in the internal space A1 of the track 4 (see FIG. 8B). The same configuration needs to be used also for the power supply units 40E. In the present preferred embodiment, the power supply units 40E are divided across the gap 40G, and terminal boxes 40T are provided on the front and the rear of the gap 40G in the X-direction as illustrated in FIG. 4. Cables C and the like of the power supply unit 40E are drawn out from the terminal boxes 40T to the external space A2 of the track 4, and these cables C are connected in the external space A2.

As illustrated in FIGS. 3 and 4, the second inspection device 60B is disposed at a position rearward in the traveling direction D1 when viewed from the traveling vehicle 6 stopping at the inspection position P1. The distance between the inspection position P1 and the second inspection device 60B is about two meters, for example. The second inspection device 60B is a device configured to check the operation of the light emitter 54B mounted on the traveling vehicle 6 stopping at the inspection position P1. The light receiver 70B of the second inspection device 60B is movable to advance into the travel space of the traveling vehicle 6 at a time of inspection for checking the operation of the light emitter 54B and to retreat from the travel space of the traveling vehicle 6 at a time of passage when the traveling vehicle 6 passes through an advance position of the light receiver 70B (at the time of passage without checking the operation of the light emitter 54B). More specifically, the light receiver 70B of the second inspection device 60B is movable between the internal space A1 and the external space A2, and is driven by a second drive unit 64B so as to advance into the internal space A1 at the time of inspection and to retreat into the external space A2 at the time of passage.

The configuration of the second inspection device 60B is similar to that of the first inspection device 60A described with reference to mainly FIGS. 5 through 7. Specifically, the second inspection device 60B differs from the first inspection device 60A in that the light receiver 70B is provided instead of the light emitter 70, but the configuration that allows the light receiver 70B to move between the internal space A1 and the external space A2 is the same as that of the first inspection device 60A. More specifically, the second inspection device 60B includes a plate 61B, a slide mechanism 63B, the second drive unit 64B, the lower connecting member 65, and the upper connecting member 66. The second inspection device 60B also includes a cable 72 connected to the light receiver 70B and a cable guide 75. The first inspection device 60A and the second inspection device 60B differ in that these components are located in a manner reversed left to right (laterally symmetrical about the inspection position P1) when viewed from side (Y-direction). Herein, a detailed description of each component included in the second inspection device 60B is omitted.

In this configuration of the second inspection device 60B, disturbance light can be prevented from entering the internal space A1 between the traveling vehicle 6 and the plate 61B of the second inspection device 60B (i.e., the space through which light emitted from the light emitter 54B passes in the internal space A1 between the light emitter 54B and the light receiver 70B) from the external space A2. More specifically, disturbance light can be prevented from entering the internal space A1 between the plate 61 of the first inspection device 60A and the plate 61B of the second inspection device 60B from the external space A2.

As illustrated in FIGS. 3 and 4, the third inspection device 80 is disposed at a position forward in the traveling direction D1 when viewed from the traveling vehicle 6 stopping at the inspection position P1. The distance between the inspection position P1 and the third inspection device 80 is about three meters, for example. The third inspection device 80 is a device configured to check the operation of the anti-collision sensor 34A and the obstacle sensor 34B mounted on the traveling vehicle 6 stopping at the inspection position P1. A first target plate (detectable portion/reflective member) 84 of the third inspection device 80 is movable to advance into the travel space of the traveling vehicle 6 at a time of inspection for checking the operation of the anti-collision sensor 34A and to retreat from the travel space of the traveling vehicle 6 at a time of passage when the traveling vehicle 6 passes through an advance position of the first target plate 84 (during normal operation without checking the operation of the anti-collision sensor 34A). A second target plate (detectable portion/reflective member) 85 of the third inspection device 80 is movable to advance into the travel space of the traveling vehicle 6 at a time of inspection for checking the operation of the obstacle sensor 34B and to retreat from the travel space of the traveling vehicle 6 at a time of passage when the traveling vehicle 6 passes through an advance position of the second target plate 85 (during normal operation without checking the operation of the obstacle sensor 34B).

Figure 9B:
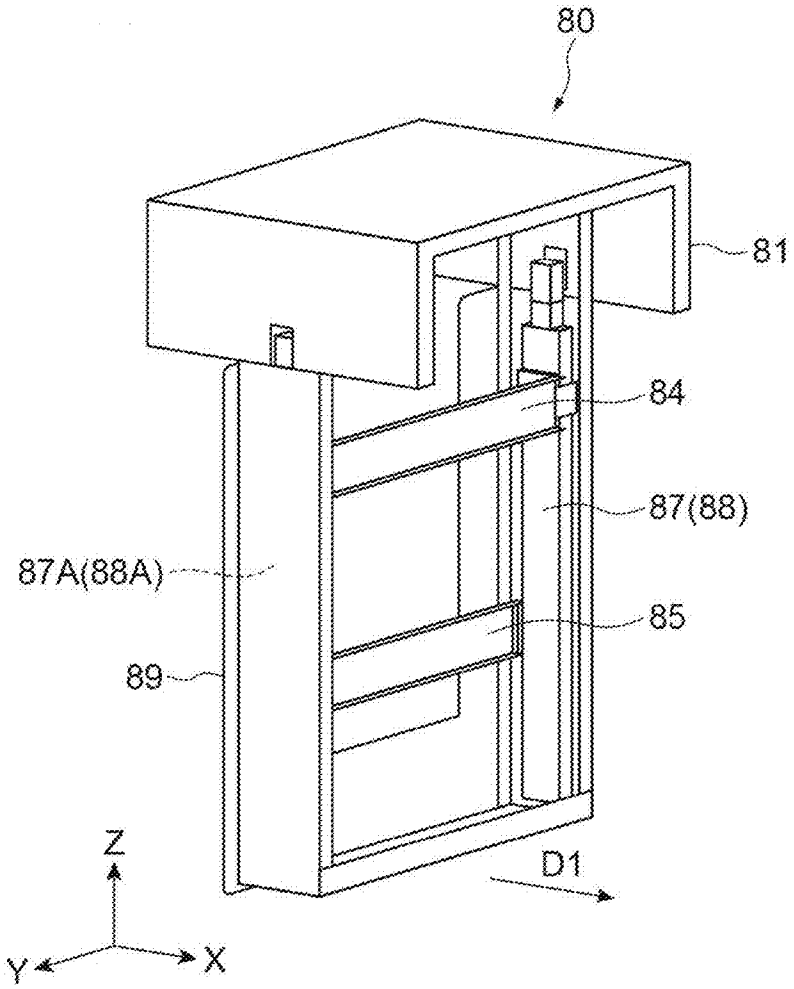
FIG. 9B is a perspective view of the third inspection device when the first target plate and the second target plate are in an advance state.
Figure 9A:
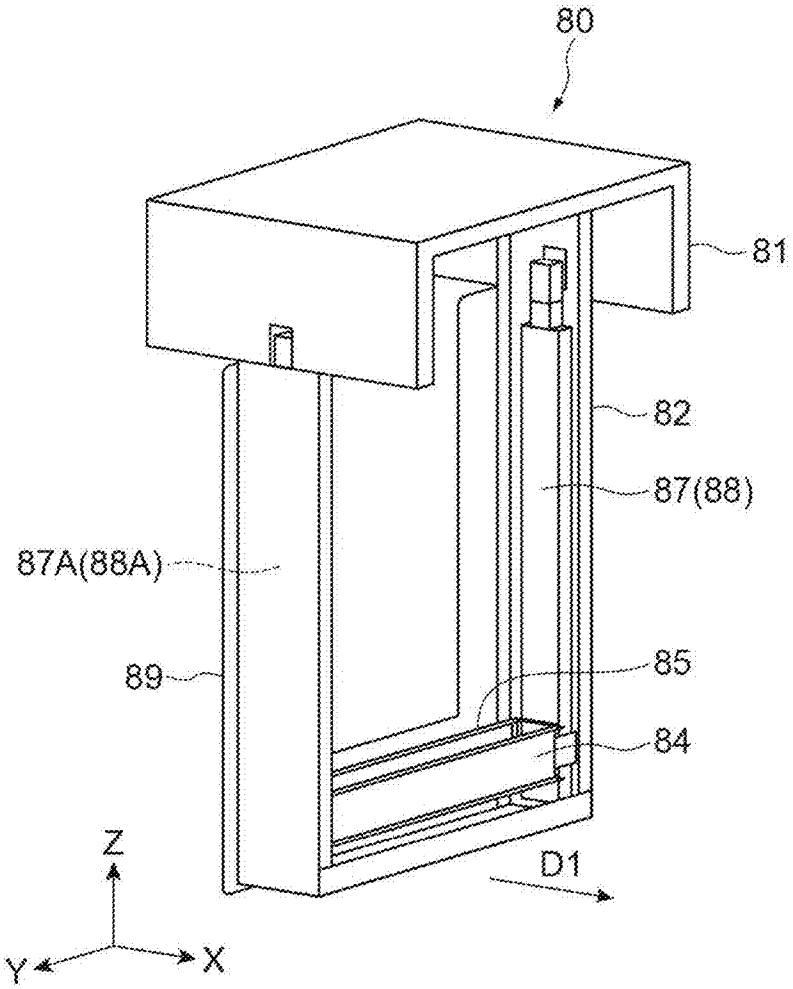
FIG. 9A is a perspective view of a third inspection device when a first target plate and a second target plate are in a retreat state.
Figure 10:
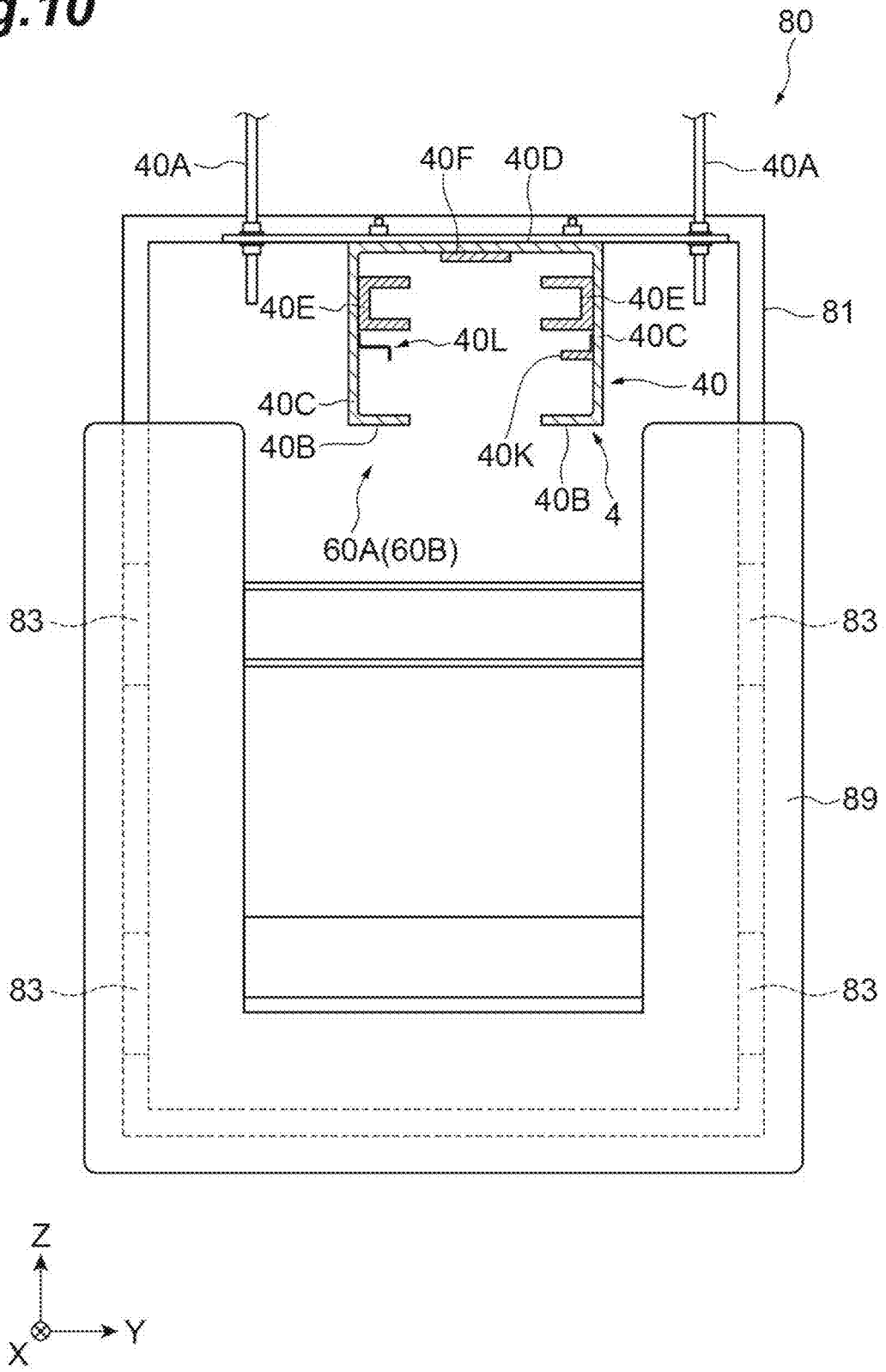
FIG. 10 is a front view of the third inspection device when viewed from the inspection position.

As illustrated in FIGS. 9A, 9B, and 10, the third inspection device 80 includes a fixed portion 81, a frame-shaped body 82, the first target plate 84, the second target plate 85, a left slide mechanism 87, a third drive unit 88, a right slide mechanism 87A, a fourth drive unit 88A, and a third target plate 89. The following describes the respective components of the third inspection device 80 in detail.

The fixed portion 81 is fixed to the ceiling or the track 4 and supports the frame-shaped body 82 in a suspended manner. The frame-shaped body 82 surrounds the travel space of the traveling vehicle 6 so that the traveling vehicle 6 can pass therethrough when viewed from the X-direction of the traveling vehicle 6. On the first target plate 84, a reflective sticker similar to a reflective sticker stuck on at least a portion of the rear cover 33 of the traveling vehicle 6 is stuck. The first target plate 84 reflects, with the reflective sticker, light emitted from the anti-collision sensor 34A. Herein, the light emitted from the anti-collision sensor 34A is reflected only by the reflective sticker and is not reflected by other members. The second target plate 85 reflects light emitted from the obstacle sensor 34B.

The first target plate 84 is connected to the left slide mechanism 87 disposed on the left side of the frame-shaped body 82 when the third inspection device 80 is viewed from the inspection position P1. The left slide mechanism 87 is a linear guide, for example, and supports the first target plate 84 movably in the Z-direction. The left slide mechanism 87 is driven by the third drive unit 88. The third drive unit 88 is capable of communicating with the transport controller 90 (see FIG. 11) and is controlled by the transport controller 90. The first target plate 84 is attached to the left slide mechanism 87 thus configured, and thus can move with respect to the travel space of the traveling vehicle 6. The first target plate 84 retreats below the travel space.

The second target plate 85 is connected to the right slide mechanism 87A disposed on the right side of the frame-shaped body 82 when the third inspection device 80 is viewed from the inspection position P1. The right slide mechanism 87A is a linear guide, for example, and supports the second target plate 85 movably in the Z-direction. The right slide mechanism 87A is driven by the fourth drive unit 88A. The fourth drive unit 88A is capable of communicating with the transport controller 90 (see FIG. 11) and is controlled by the transport controller 90. The second target plate 85 is attached to the right slide mechanism 87A thus configured, and thus can move with respect to the travel space of the traveling vehicle 6. The second target plate 85 retreats below the travel space.

The first target plate 84 and the second target plate 85 are configured to retreat below the travel space by their own weight in a situation when power is not supplied to the third inspection device 80 for some reason (e.g., power failure). In the retreat position of the first target plate 84 and the second target plate 85, a cushioning member configured to absorb a shock when the first target plate 84 and the second target plate 85 fall due to their own weight is provided.

The third target plate 89 is a flat plate on a side from which the traveling vehicle 6 enters. The third target plate 89 is configured to be able to reflect light emitted from the anti-collision sensor 34A. On at least a portion of the third target plate 89, a reflective sticker is provided.

Position detection sensors 83 detect the positions of the first target plate 84 and the second target plate 85. In other words, the position detection sensors 83 detect whether the first target plate 84 and the second target plate 85 are advancing into the travel space of the traveling vehicle 6. The detection results by the position detection sensors 83 is acquired by the transport controller 90.

Figure 11:
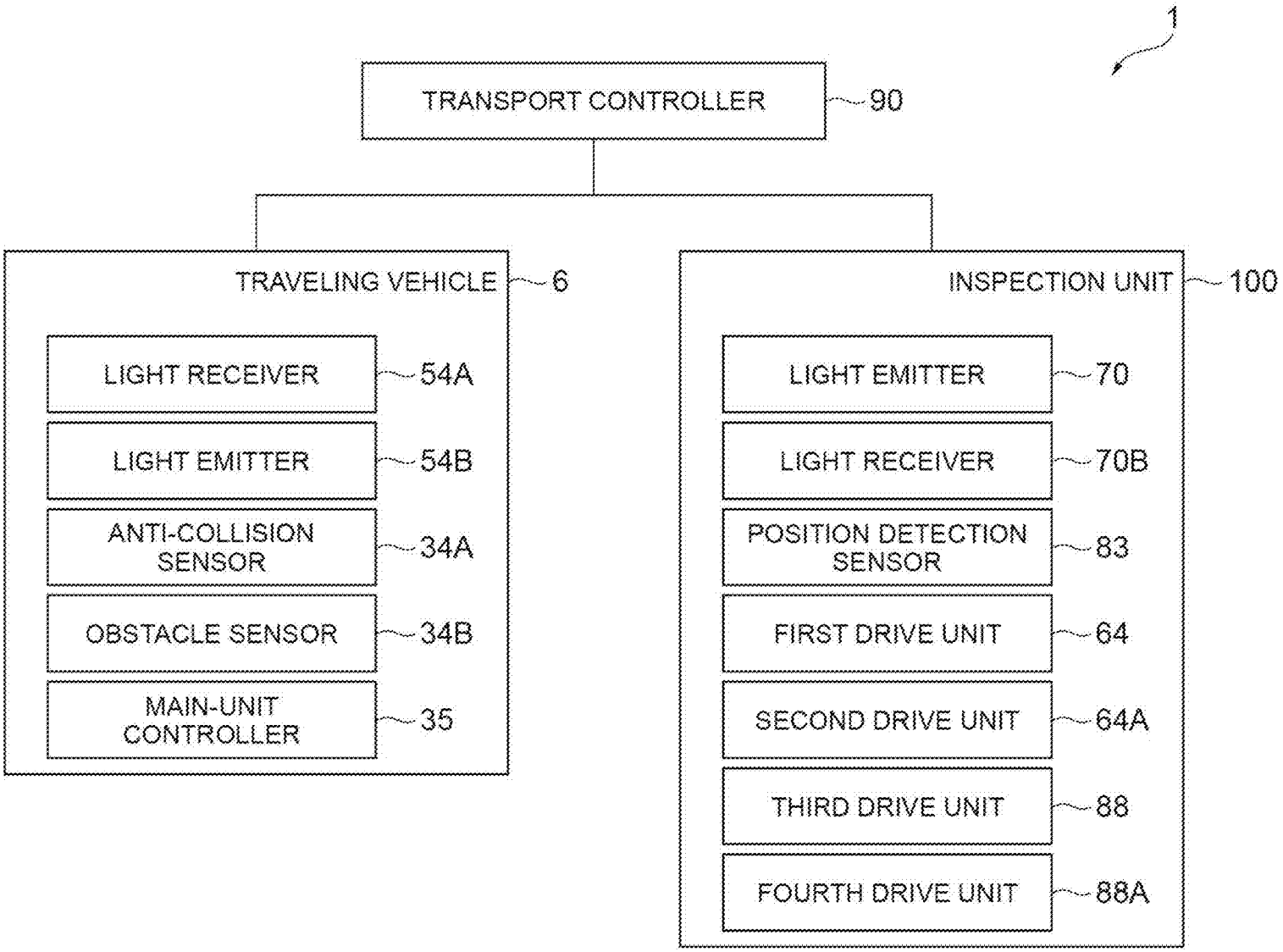
FIG. 11 is a block diagram illustrating a functional configuration of the rail-guided vehicle system.

As illustrated in FIG. 11, the transport controller 90 controls the traveling vehicles 6 configured to travel on the track 4 via the main-unit controllers 35. The transport controller 90 also controls the light emitter 70, the light receiver 70B, the position detection sensors 83, the first drive unit 64, the second drive unit 64B, the third drive unit 88, and the fourth drive unit 88A included in the inspection unit 100.

The transport controller 90 causes each traveling vehicle 6 to travel to the inspection unit 100 under predetermined conditions as triggers. The predetermined conditions are, for example, when an inspection start instruction is input by an operator via an input unit (not illustrated), or when the traveling vehicle 6 appears after a predetermined time has elapsed since it had been inspected last time, or when a traveling vehicle 6 that has traveled a predetermined distance since it had been inspected last time, and the like. The transport controller 90 causes a traveling vehicle 6, which meets the conditions, to travel to the inspection position P1 of the inspection unit 100.

When the traveling vehicle 6 has reached the inspection position P1, the transport controller 90 controls the first drive unit 64 to cause the light emitter 70 of the first inspection device 60A to advance into the internal space A1, and controls the second drive unit 64B to cause the light receiver 70B of the second inspection device 60B to advance into the internal space A1. The transport controller 90 controls the light emitter 70 of the first inspection device 60A and causes it to emit light. The transport controller 90 determines the state of the light receiver 54A on the basis of the detection result by the light receiver 54A of the traveling vehicle 6 at this time. Specifically, if the light can be detected, it is determined that there is no abnormality in the light receiver 54A of the traveling vehicle 6, and if the light cannot be detected, it is determined that there is an abnormality in the light receiver 54A of the traveling vehicle 6.

The transport controller 90 controls the light emitter 54B of the traveling vehicle 6 via the main-unit controller 35 and causes it to emit light. The transport controller 90 determines the state of the light emitter 54B on the basis of the detection result by the light receiver 70B of the second inspection device 60B at this time. Specifically, if the light receiver 70B of the second inspection device 60B can detect the light, it is determined that there is no abnormality in the light emitter 54B of the traveling vehicle 6, and if the light receiver 70B of the second inspection device 60B cannot detect the light, it is determined that there is an abnormality in the light emitter 54B of the traveling vehicle 6.

The transport controller 90 controls the third drive unit 88 to cause the first target plate 84 to advance into the travel space of the traveling vehicle 6, and controls the fourth drive unit 88A to cause the second target plate 85 advance into the travel space of the traveling vehicle 6. The transport controller 90 controls the anti-collision sensor 34A of the traveling vehicle 6 and causing it to emit light. The transport controller 90 determines the state of the anti-collision sensor 34A on the basis of the detection result by the anti-collision sensor 34A at this time. Specifically, if the light can be detected, it is determined that there is no abnormality in the anti-collision sensor 34A, and if the light cannot be detected, it is determined that there is an abnormality in the anti-collision sensor 34A.

The amount of light received at the anti-collision sensor 34A varies with the reflected amount of light emitted from the anti-collision sensor 34A that is reflected by the first target plate 84 and the third target plate 89. The transport controller 90 determines whether the optical axis of the anti-collision sensor 34A is misaligned in the right-and-left direction on the basis of the amount of the light received by the anti-collision sensor 34A.

The transport controller 90 controls the obstacle sensor 34B of the traveling vehicle 6 and causes it to emit light. The transport controller 90 determines the state of the obstacle sensor 34B on the basis of the detection result by the obstacle sensor 34B at this time. Specifically, if the light can be detected, it is determined that there is no abnormality in the obstacle sensor 34B, and if the light cannot be detected, it is determined that there is an abnormality in the obstacle sensor 34B.

When the transport controller 90 determines that at least one of the first target plate 84 and the second target plate 85 is advancing into the travel space of the traveling vehicle 6 on the basis of the detection result of the position detection sensor 83, it prohibits the traveling vehicle 6 from entering into the third inspection device 80.

The following describes functional effects of the rail-guided vehicle system 1 according to the preferred embodiments described above. In the rail-guided vehicle system 1 according to the above preferred embodiments, at the time of inspection when the state of the light receiver 54A of the traveling vehicle 6 positioned at the inspection position P1 is checked, the light emitter 70 is caused to advance in front of the travel space of the traveling vehicle 6, and the state of the light receiver 54A is determined based on the detection result by the light receiver 54A at this time. At the time of passage when the traveling vehicle 6 passes through the advance position of the light emitter 70, the light emitter 70 is caused to retreat from the travel space of the traveling vehicle 6 and thus does not hinder the traveling vehicle 6 from traveling.

Similarly, when the anti-collision sensor 34A of the traveling vehicle 6 is inspected, the first target plate 84 is caused to advance in front of the travel space of the traveling vehicle 6, and the state of the anti-collision sensor 34A is determined based on the detection result by the anti-collision sensor 34A at this time. Similarly, when the obstacle sensor 34B is inspected, the second target plate 85 is caused to advance in front of the travel space of the traveling vehicle 6, and the state of the obstacle sensor 34B is determined based on the detection result by obstacle sensor 34B at this time. By these configurations, the operations of the light receiver 54A, the light receiver 54A, the light emitter 54B, the anti-collision sensor 34A, and the obstacle sensor 34B provided to the traveling vehicle 6 configured to travel on the track 4 can be checked automatically.

In the rail-guided vehicle system 1 according to the above preferred embodiments, the light emitter 70 is provided so as to be movable between the internal space A1 and the external space A2, and advances into the internal space A1 at the time of inspection and retreats into the external space A2 at the time of passage. By this configuration, the operation of the light emitter 70 can be checked automatically even if the light emitter 70 is attached to the traveling unit 50 configured to travel in the internal space A1 of the track 4.

In the rail-guided vehicle system 1 according to the above preferred embodiments, the notch 40W is covered by the lid 62 when the light emitter 70 has advanced into the internal space A1 of the track 4, whereby disturbance light, for example, can be prevented from entering the internal space A1 from the external space A2. By this configuration, the operation of the light emitter 70 can be checked more reliably without being affected by disturbance light.

In the rail-guided vehicle system 1 according to the above preferred embodiments, at the time of inspection when the state of the light emitter 54B of the traveling vehicle 6 positioned at the inspection position P1 is checked, the light receiver 70B is caused to emerge behind the traveling vehicle 6, and the state of the light emitter 54B is determined based on the detection result by the light receiver 70B at this time. By this configuration, the operation of the light emitter 54B provided to the traveling vehicle 6 configured to travel on the track 4 can be checked automatically.

The preferred embodiments have been described above, but the present invention is not limited to the preferred embodiments described above. Various modifications can be made without departing from the gist of the present invention.

In the rail-guided vehicle system 1 according to the above preferred embodiments, an example has been described in which the light receiver 54A configured to receive light emitted from a forward traveling vehicle 6 is provided on the front of the traveling unit 50. However, a forward sensor including a light receiver and a light emitter may be provided instead of the light receiver 54A. In this case, a target plate capable of reflecting light emitted from the forward sensor is provided instead of the light emitter 70 provided in the first inspection device 60A. A sensor having the same configuration as that of the forward sensor may be provided on the rear of the traveling unit 50. The traveling unit 50 may be provided with distance sensors and the like instead of the sensors described above. In this case, the target plates are still used in the first inspection device 60A.

In the rail-guided vehicle system 1 according to the preferred embodiments and the modifications above, an example has been described in which the traveling unit 50 travels in the internal space A1 of the track 4. However, the traveling unit 50 may also travel on the track 4 exposing it to the external space A2.

In the rail-guided vehicle system 1 according to the preferred embodiments and the modifications, an example has been described in which the inspection unit 100 is disposed in the siding-track section 4B branching from the main-track section 4A. However, the inspection unit 100 may be provided in the main-track section 4A.

In the rail-guided vehicle system 1 according to the preferred embodiments and the modifications above, an example has been described in which the control of the traveling vehicle 6 at the time of inspection, including the control of each configuration of the inspection unit 100, is performed by the transport controller 90. However, for example, a dedicated controller may be provided to perform control of the traveling vehicle 6 at the time of inspection, including control of each configuration of the inspection unit 100.

In the rail-guided vehicle system 1 according to the preferred embodiments and the modifications above, an example of the carrier, which is the traveling vehicle 6, has been described. However, other examples of the carrier include unmanned traveling vehicles configured to travel on the track 4 installed on a floor or trestles.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A rail-guided vehicle system comprising:

a plurality of carriers each being movable along a track and including at least one obstacle detector to detect a carrier located forward in a traveling direction;

at least one detectable portion in front of each carrier positioned at a predetermined position and detectable by the at least one obstacle detector; and a controller to determine a state of the at least one obstacle detector based on a detection result of the at least one detectable portion by the at least one obstacle detector; wherein the at least one detectable portion is movable into a travel space of the carrier at a time of inspection to check operation of the obstacle detector and to retreat from the travel space of the carrier at a time of passage when the carrier passes through an advance position of the at least one detectable portion;

in the track, an internal space and a notch are provided, the internal space being separated from an external space and located along an extending direction of the track, the notch allowing a first detectable portion to move between the internal space and the external space;

the carrier includes a traveling unit to travel in the internal space;

the at least one obstacle detector is attached to the traveling unit;

the first detectable portion is movable between the internal space and the external space and to advance into the internal space at the time of inspection and to retreat into the external space at the time of passage, and is provided with a lid to cover an area through which the first detectable portion passes in the notch when the first detectable portion has advanced into the internal space;

a first obstacle detector includes a light receiver and a light emitter, and a second detectable portion includes a reflector capable of reflecting light emitted from the light emitter;

the reflector is movably attached to a frame-shaped body surrounding the travel space of the carrier so as to allow the carrier to pass therethrough in the traveling direction; and the reflector is movable to advance into the travel space of the carrier at the time of inspection and to retreat from the travel space of the carrier at the time of passage.

2. The rail-guided vehicle system according to claim 1, wherein the first detectable portion includes a light emitter attached to a plate and a second obstacle detector includes a light receiver to receive light emitted from the light emitter attached to the plate and light emitted from a rear light emitter provided to a forward carrier located forward in the traveling direction; and the controller is configured or programmed to detect a presence or absence of the carrier located forward in the traveling direction, based on a detection result of the light from the light emitter provided to the forward carrier by the light receiver, and determine a state of the light receiver, based on a detection result of the light from the light emitter provided to the plate by the light receiver.

3. The rail-guided vehicle system according to claim 2, wherein the carrier includes a rear light emitter configured to cause a carrier located behind on the track to detect presence of the carrier, the rail-guided vehicle system further includes a light-emitter detector provided behind the carrier positioned at the predetermined position and configured to detect light emitted from the rear light emitter, the light-emitter detector is movably provided so as to advance into the travel space of the carrier at time of inspection for checking operation of the rear light emitter and to retreat from the travel space of the carrier at time of passage when the carrier passes through an advance position of the light-emitter detector, and the controller determines a state of the rear light emitter, based on a detection result by the light-emitter detector.

4. The rail-guided vehicle system according to claim 1, wherein the carrier includes a rear light emitter to cause a carrier located behind on the track to detect a presence of the carrier;

the rail-guided vehicle system further includes a light-emitter detector provided behind the carrier positioned at the predetermined position to detect light emitted from the rear light emitter;

the light-emitter detector is movable to advance into the travel space of the carrier at a time of inspection to check operation of the rear light emitter and to retreat from the travel space of the carrier at a time of passage when the carrier passes through an advance position of the light-emitter detector; and the controller is configured or programmed to determine a state of the rear light emitter based on a detection result by the light-emitter detector.

* * * * *